US010245841B2

(12) United States Patent
Asaka et al.

(10) Patent No.: US 10,245,841 B2
(45) Date of Patent: Apr. 2, 2019

(54) INKJET HEAD AND INKJET RECORDING APPARATUS

(71) Applicant: KONICA MINOLTA, INC., Chiyoda-ku, Tokyo (JP)

(72) Inventors: Yoshinori Asaka, Hachioji (JP); Takashi Matsuo, Suita (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/760,809

(22) PCT Filed: Sep. 12, 2016

(86) PCT No.: PCT/JP2016/076737

§ 371 (c)(1),
(2) Date: Mar. 16, 2018

(87) PCT Pub. No.: WO2017/047534

PCT Pub. Date: Mar. 23, 2017

(65) Prior Publication Data

US 2018/0257386 A1 Sep. 13, 2018

(30) Foreign Application Priority Data

Sep. 18, 2015 (JP) ..... 2015-184587

(51) Int. Cl.
*B41J 2/19* (2006.01)
*B41J 2/18* (2006.01)
(Continued)

(52) U.S. Cl.
CPC ..... *B41J 2/19* (2013.01); *B41J 2/055* (2013.01); *B41J 2/14201* (2013.01);
(Continued)

(58) Field of Classification Search
CPC . B41J 2/19; B41J 2/055; B41J 2/14201; B41J 2/14233; B41J 2/18; B41J 2/1707
See application file for complete search history.

(56) References Cited

U.S. PATENT DOCUMENTS 7,128,407 B2 * 10/2006 Inoue ..... B41J 2/175 347/85
7,434,920 B2 * 10/2008 Noguchi ..... B41J 2/17513 347/85
8,926,057 B2 * 1/2015 Ueno ..... B41J 2/16508 347/21

FOREIGN PATENT DOCUMENTS

CN 106794695 A 5/2017
CN 107107618 A 8/2017
(Continued)

OTHER PUBLICATIONS

Extended European Search Report corresponding to Application No. 16846405.5-1019/3351389 PCT/JP2016076737; dated Sep. 10, 2018.
(Continued)

*Primary Examiner* — Lamson Nguyen
(74) *Attorney, Agent, or Firm* — Cantor Colburn LLP

(57) ABSTRACT

Provided are an inkjet head and an inkjet recording apparatus which are compact and are capable of realizing high resolution, and are capable of stably ejecting liquid droplets at a high frequency while having a structure capable of circulating ink. The inkjet head includes: a plurality of nozzles which eject ink; a plurality of pressure chambers which are respectively communicate with the plurality of nozzles and are filled with ink; a plurality of pressure generation portions which apply a pressure to ink inside the plurality of pressure chamber; a circulation flow passage that is provided to be branched from an ink flow passage ranging from an inlet of the pressure chambers and an outlet of the
(Continued)

nozzles, and is capable of discharging ink inside the plurality of pressure chambers; and a first damper and a second damper which are provided to face the circulation flow passage, and is capable of changing a volume of the circulation flow passage through elastic deformation in correspondence with a pressure.

20 Claims, 7 Drawing Sheets

(51) Int. Cl.
*B41J 2/055* (2006.01)
*B41J 2/14* (2006.01)
*B41J 2/17* (2006.01)

(52) U.S. Cl.
CPC ..... *B41J 2/14233* (2013.01); *B41J 2/1707* (2013.01); *B41J 2/18* (2013.01); *B41J 2002/14241* (2013.01); *B41J 2002/14419* (2013.01); *B41J 2002/14491* (2013.01); *B41J 2202/12* (2013.01); *B41J 2202/18* (2013.01)

(56) References Cited

FOREIGN PATENT DOCUMENTS

| | | | |
|---|---|---|---|
| EP | 2726295 | A1 | 5/2014 |
| EP | 3196025 | A1 | 7/2017 |
| EP | 3246165 | A1 | 11/2017 |
| JP | H09141856 | A | 6/1997 |
| JP | 2008290292 | A | 12/2008 |
| JP | 2009143168 | A | 7/2009 |
| JP | 5563332 | B2 | 7/2014 |

OTHER PUBLICATIONS

International Search Report corresponding to Application No. PCT/JP2016/076737; dated Oct. 25, 2016.
Written Opinion of the International Searching Authority corresponding to Application No. PCT/JP2016/076737; dated Oct. 25, 2016.
SIPO First Office Action corresponding to Application No. 201680053278.2; dated Dec. 11, 2018.

* cited by examiner

INKJET HEAD AND INKJET RECORDING APPARATUS

CROSS REFERENCE TO RELATED APPLICATIONS

This is the U.S. national stage of application No. PCT/JP2016/076737, filed on Sep. 12, 2016. Priority under 35 U.S.C. § 119(a) and 35 U.S.C. § 365(b) is claimed from Japanese Application No. 2015-184587, filed on Sep. 18, 2015, the disclosure of which is also incorporated herein by reference.

TECHNICAL FIELD

The present invention relates to an inkjet head and an inkjet recording apparatus.

BACKGROUND ART

In the related art, there is known an inkjet recording apparatus that forms an image on a recording medium by ejecting liquid droplets of an ink from a plurality of nozzles provided in an inkjet head.

In the inkjet recording apparatus, the nozzles may be clogged due to air bubbles generated in the inkjet head, foreign matters which are mixed into the inkjet head, and the like, and thus a problem such as ejection failure may occur in some cases. In addition, in accordance with the kind of the ink, when being left without use for a long period of time, an ink viscosity in the vicinity of the nozzles may increase due to descending of ink particles and the like, and thus it may be difficult to obtain stable ink ejection performance.

Therefore, there is known an inkjet recording apparatus in which a circulation flow passage of ink is provided in a head chip of the inkjet head to allow air bubbles and the like inside the head to flow through the circulation flow passage in combination with the ink.

For example, Patent Literature 1 discloses an inkjet head including nozzles which are arranged in a plurality of rows, a common supply flow passage (a fluid inlet passage) through which ink is commonly supplied to each of respective pressure chambers (pump chambers) each communicating to each nozzle, and a common circulation flow passage (recirculation channel) with which a plurality of circulation flow passage, from which ink in the vicinity of the nozzle is discharged, communicate.

CITATION LIST

Patent Literature

Patent Literature 1: JP 5563332 B2

SUMMARY OF INVENTION

Technical Problem

However, recently, it is required to dispose nozzles in a high density for miniaturization of an inkjet or high resolution of an image. However, as described in Patent Literature 1, in a configuration in which the head chip is provided with the common supply flow passage and the common circulation flow passage, the common circulation flow passage and the common supply flow passage (common supply-liquid chamber), which have a relatively great volume, are necessary to be provided inside the head chip. Accordingly, the head chip is likely to increase in size, and thus there is a problem that it is difficult to dispose the nozzles in a high density.

In addition, in a case where the circulation flow passage is simply made to be narrow so as to make the head chip small, pressure fluctuation inside the circulation flow passage is likely to occur, or ink supply from the ink circulation flow passage to the pressure chamber may be deficient after liquid droplet ejection. Accordingly, in a case where a circulation flow rate is made to be fast so as to efficiently perform removal of air bubbles and the like or in a case where a supply force is deficient, there is a concern that a meniscus of a nozzle is broken, and ink is leaked from the nozzle.

The invention has been made in consideration of the above-described problems, and an object thereof is to provide an inkjet head and an inkjet recording apparatus which are compact and are capable of realizing high resolution, and are capable of stably ejecting liquid droplets at a high frequency while having a structure capable of circulating ink.

Solution to Problem

To solve the above-described problems, the invention according to claim 1 is an inkjet head, including:

a plurality of nozzles which eject ink;

a plurality of pressure chambers which are respectively communicate with the plurality of nozzles and are filled with ink;

a plurality of pressure generation means which are respectively provided in correspondence with the plurality of pressure chambers, and apply a pressure to ink inside the pressure chambers;

a circulation flow passage that is provided to be branched from an ink flow passage ranging from an inlet of the pressure chambers and an outlet of the nozzles, and is capable of discharging ink inside the plurality of pressure chambers; and a damper that is provided to face the circulation flow passage, and is capable of changing a volume of the circulation flow passage through elastic deformation in correspondence with a pressure.

The invention according to claim 2 is, the inkjet head according to claim 1, wherein the circulation flow passage is provided to be branched from a portion, which ranges from an end on an outlet side of the pressure chambers to the outlet of the nozzles, in the ink flow passage.

The invention according to claim 3 is, the inkjet head according to claim 1 or 2, wherein the ink flow passage includes a communication passage through which each of the nozzles and each of the pressure chambers communicate with each other, and the circulation flow passage is provided to be branched from the communication passage.

The invention according to claim 4 is, the inkjet head according to any one of claims 1 to 3, wherein the circulation flow passage includes a plurality of individual circulation flow passages which communicate with the ink flow passage, and a common circulation flow passage through which at least two of the plurality of individual circulation flow passages communicate with each other, and the damper is provided to face the common circulation flow passage.

The invention according to claim 5 is, the inkjet head according to claim 4, wherein the damper is provided on at least one side of an upper side and a lower side of the common circulation flow passage, and includes an air chamber, which faces the damper, on a side opposite to the common circulation flow passage.

The invention according to claim 6 is, the inkjet head according to claim 5, wherein a volume of the air chamber is smaller than a volume of the common circulation flow passage.

The invention according to claim 7 is, the inkjet head according to claim 5 or 6, wherein the air chamber includes an air communication portion that communicates with the air.

The invention of claim 8 is, the inkjet head according to any one of claims 4 to 7, wherein the plurality of nozzles are arranged in one row or a plurality of rows, and a region, in which the damper is provided, further extends in an arrangement direction of the plurality of nozzles in comparison to a position of a nozzle at an end of a region in which the plurality of nozzles are provided in an arrangement direction of the plurality of nozzles.

The invention according to claim 9 is, the inkjet head according to any one of claims 4 to 8, wherein the plurality of nozzles are arranged in a plurality of rows, and the common circulation flow passage is provided for each row or for every two rows among the plurality of rows.

The invention according to claim 10 is an inkjet recording apparatus, including:

the inkjet head according to any one of claims 1 to 9; and circulation means that generates a circulating flow from the ink flow passage to the circulation flow passage.

Advantageous Effects of Invention

According to the invention, in an inkjet head including a flow passage through which ink can circulate, a compact size and high resolution are realized, and the inkjet head can stably eject liquid droplets at a high frequency while having a structure capable of circulating ink.

DESCRIPTION OF EMBODIMENTS

Figure 1:
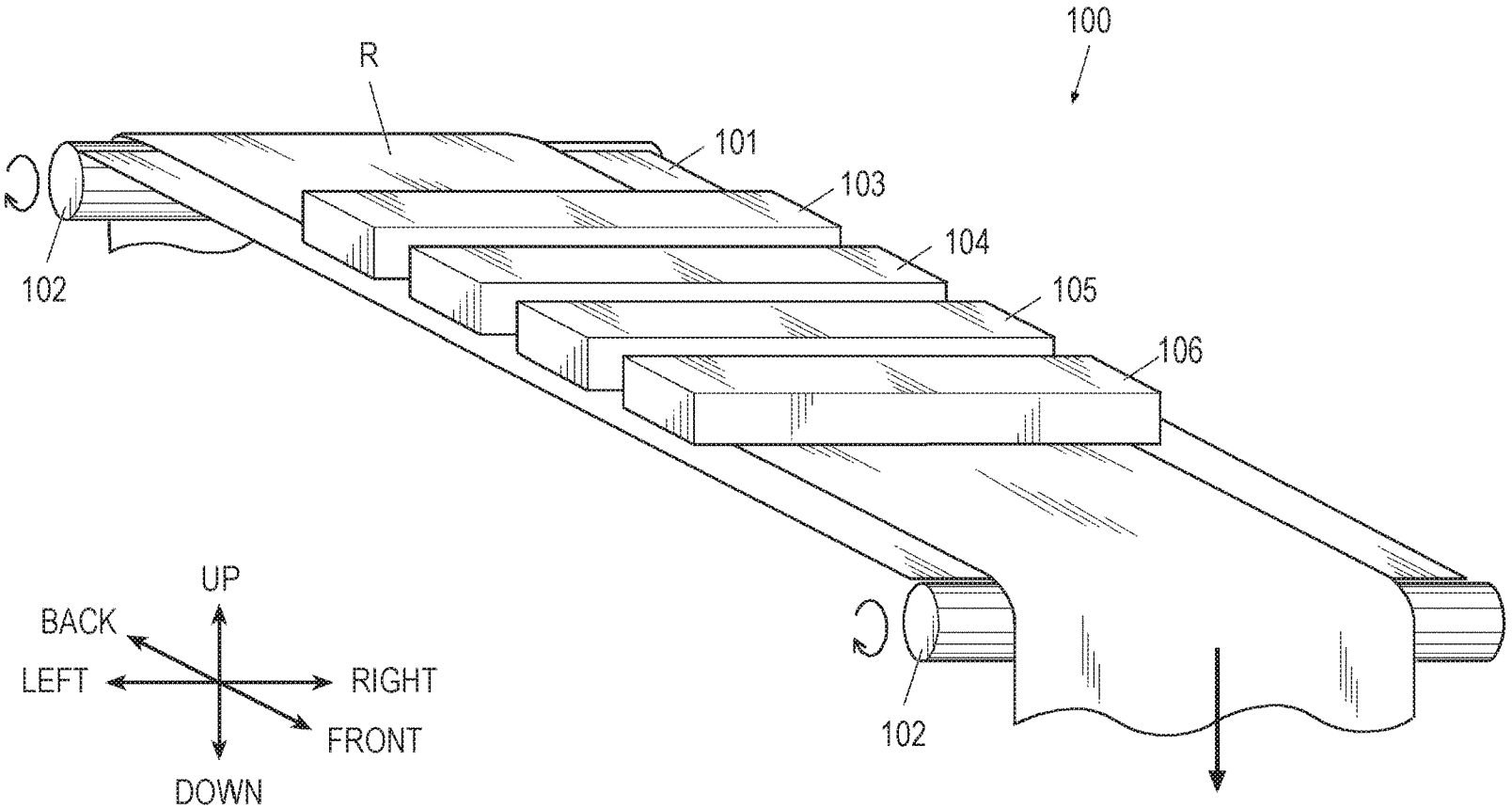
FIG. 1 is a perspective view illustrating a schematic configuration of an inkjet recording apparatus.

Hereinafter, preferred embodiments of the invention will be described with reference to the accompanying drawings. However, the scope of the invention is not limited to examples illustrated. In addition, in the following description, the same reference numeral will be given to a member having the same function and the same configuration, and description thereof will be omitted.

Furthermore, in the following description, description will be given with reference to embodiments in a one-pass drawing method of performing drawing with only transportation of a recording medium by using a line head, but application of an appropriate drawing method is possible. For example, it is possible to employ a drawing method using a scan method and a drum method.

In addition, in the following description, description will be given on the assumption that a transportation direction of a recording medium R is set to a front-back direction, a direction perpendicular to the transportation direction on a transportation surface of the recording medium R is set to a right-left direction, and a direction (ink ejection direction) perpendicular to the front-back direction and the right-left direction is set to an up-down direction.

[Overview of Inkjet Recording Apparatus]

Figure 6:
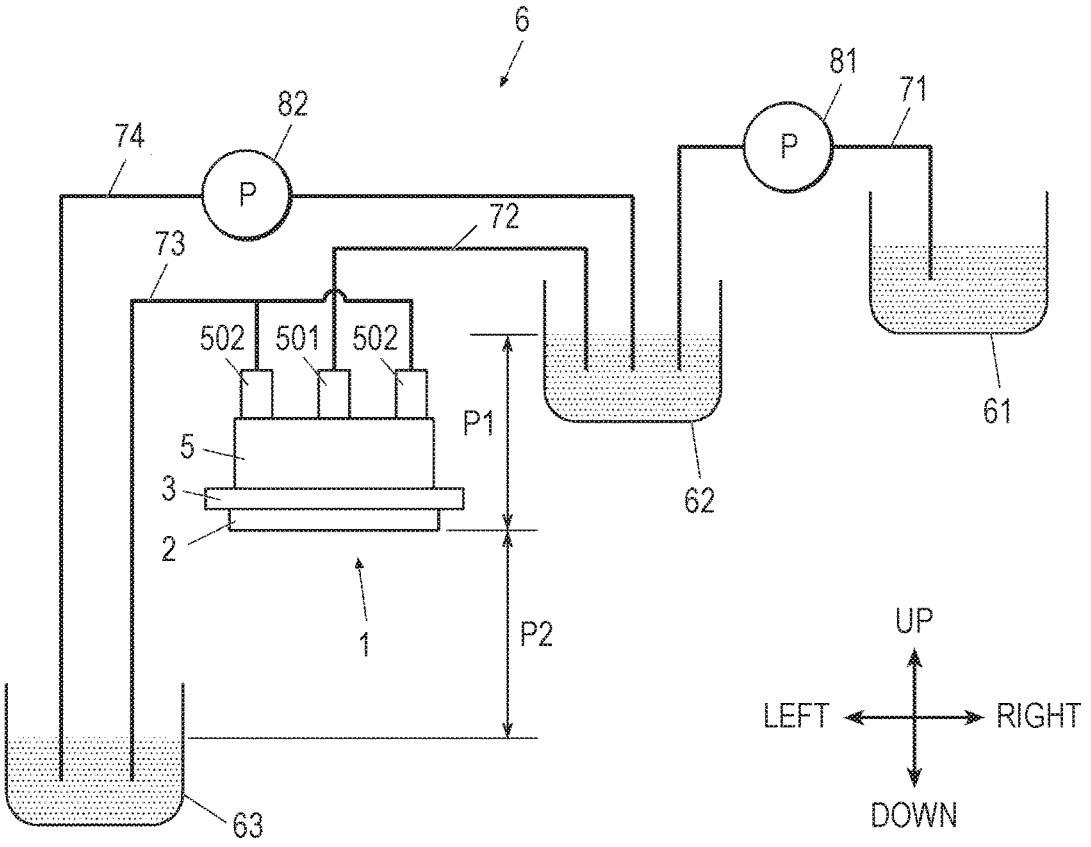
FIG. 6 is a schematic view illustrating a configuration of an ink circulation mechanism.

An inkjet recording apparatus 100 includes a platen 101, a transporting roller 102, line heads 103, 104, 105, and 106, and an ink circulation mechanism 6, and the like (refer to FIG. 1 and FIG. 6).

The platen 101 supports the recording medium R on an upper surface thereof, and transports the recording medium R in a transporting direction (front-back direction) when the transporting roller 102 is driven.

The line heads 103, 104, 105, and 106 are provided in parallel to a width direction (right-left direction), which is perpendicular to the transporting direction, from an upstream side to a downstream side in the transporting direction (front-back direction) of the recording medium R. In addition, at least one inkjet head 1 to be described later is provided on an inner side of the line heads 103, 104, 105, and 106, and ejects, for example, ink of cyan (C), magenta (M), yellow (Y), and black (K) toward the recording medium R.

Furthermore, the ink circulation mechanism 6 will be described later (refer to FIG. 6).

[Inkjet Head]

A configuration of the inkjet head 1 will be described with reference to FIG. 2 to FIG. 5.

Figure 3A:
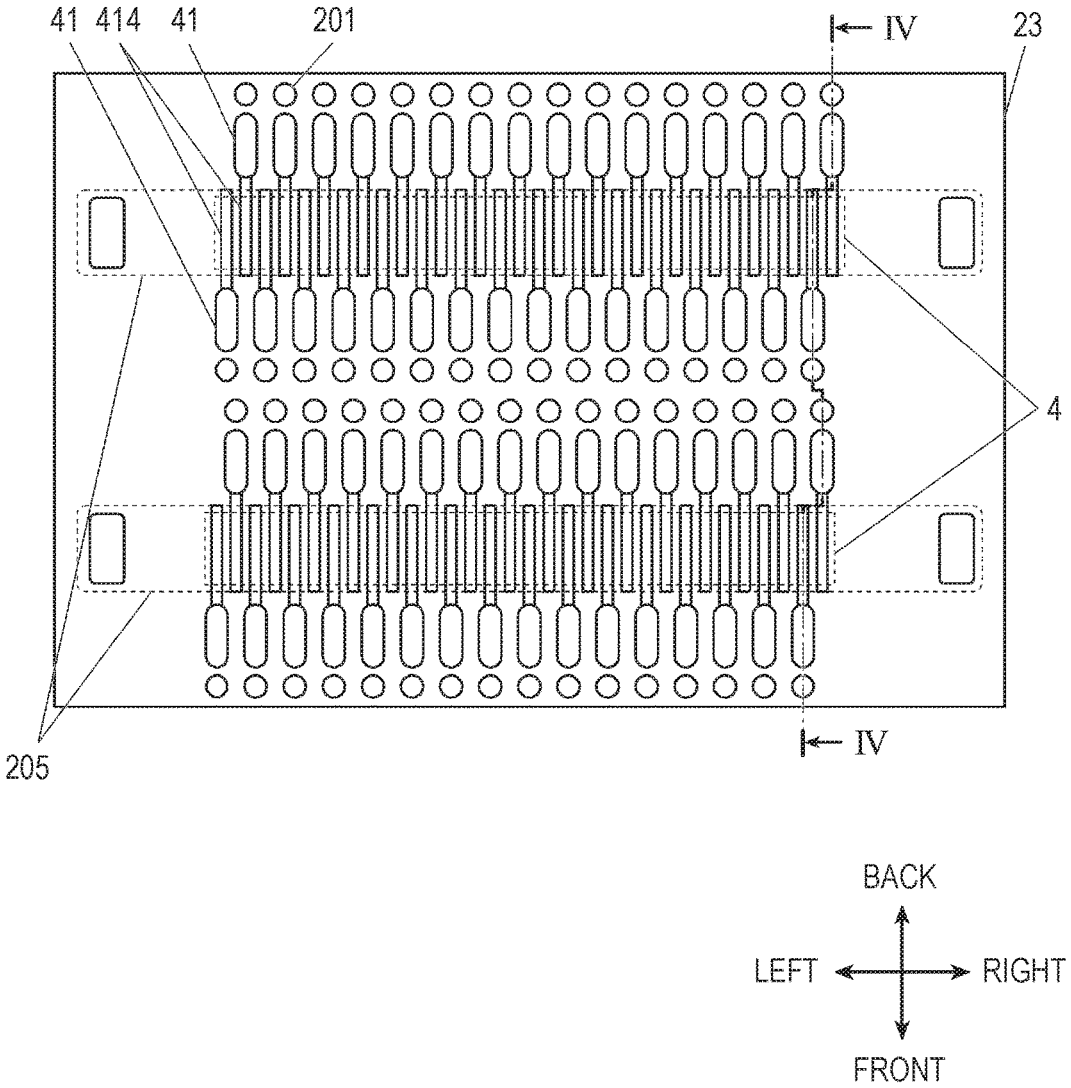
FIG. 3A is a plan view illustrating a main portion of an upper surface of an actuator substrate in a head chip.
Figure 3B:
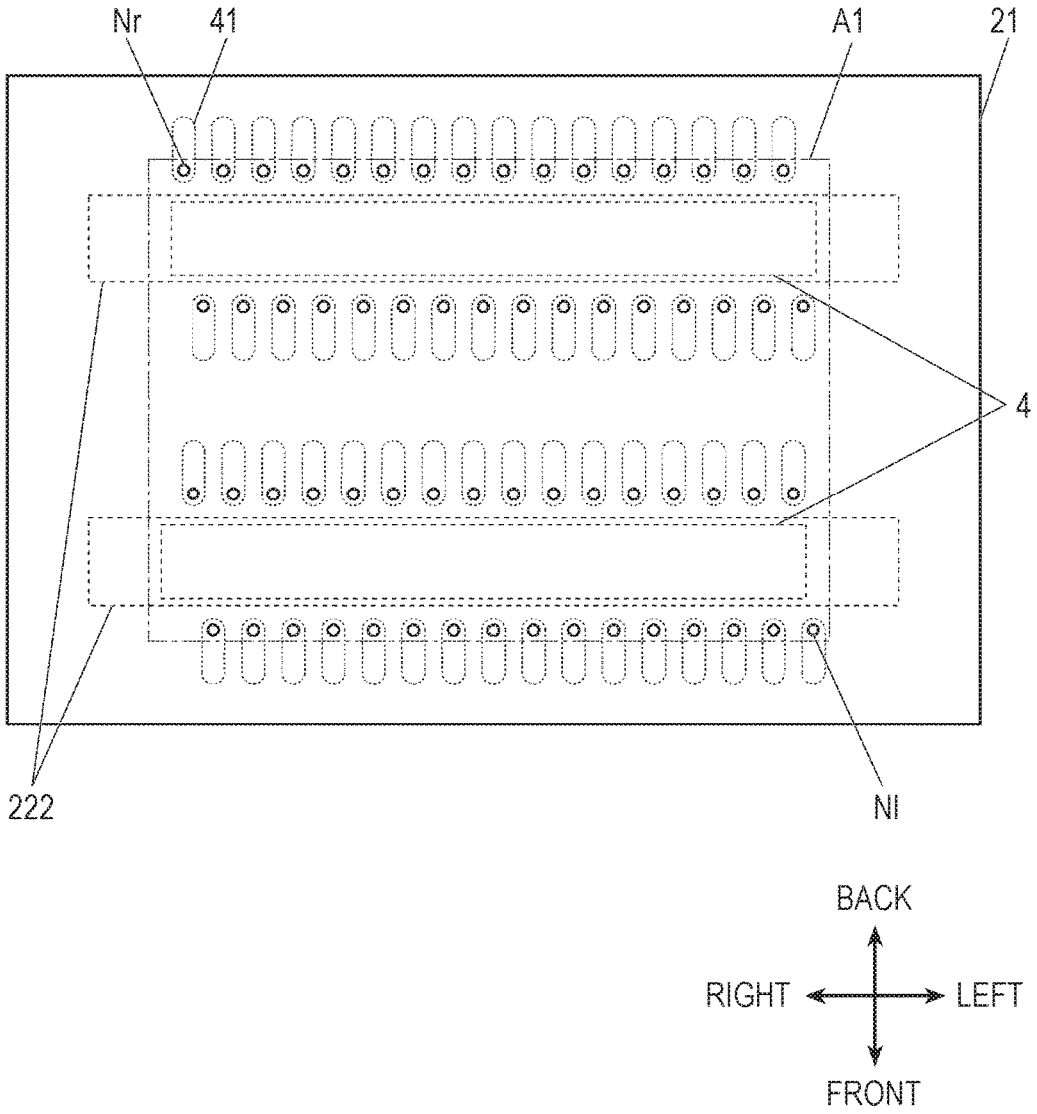
FIG. 3B is a bottom view of a nozzle substrate.

Furthermore, FIG. 3A is a plan view illustrating a main portion of an upper surface of an actuator substrate 23 for description of arrangement of piezoelectric substances 41 and individual interconnections 414 inside a head chip. In addition, FIG. 3B is a bottom view of a nozzle substrate 21. In addition, in FIG. 3A and FIG. 3B, parts of constituent elements, which are formed in another layer, are illustrated with a broken line.

Figure 4:
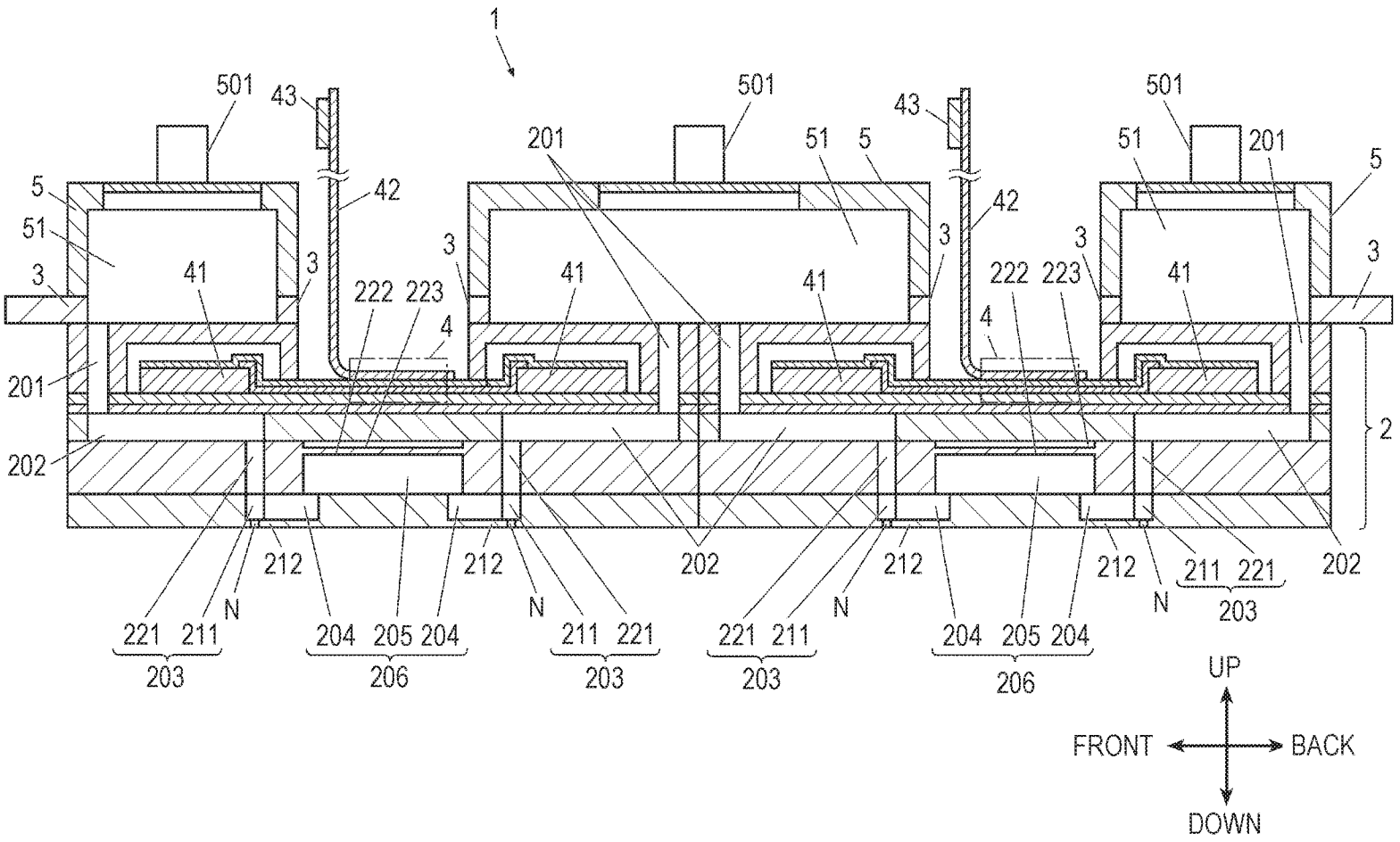
FIG. 4 is a cross-sectional view of an inkjet head which illustrates a cross-section along IV-IV in FIG. 3A.

In addition, FIG. 4 is a view illustrating a cross-section of the inkjet head 1 with respect to a plane parallel to portion IV-IV illustrated with a broken line in FIG. 3A.

Figure 2A:
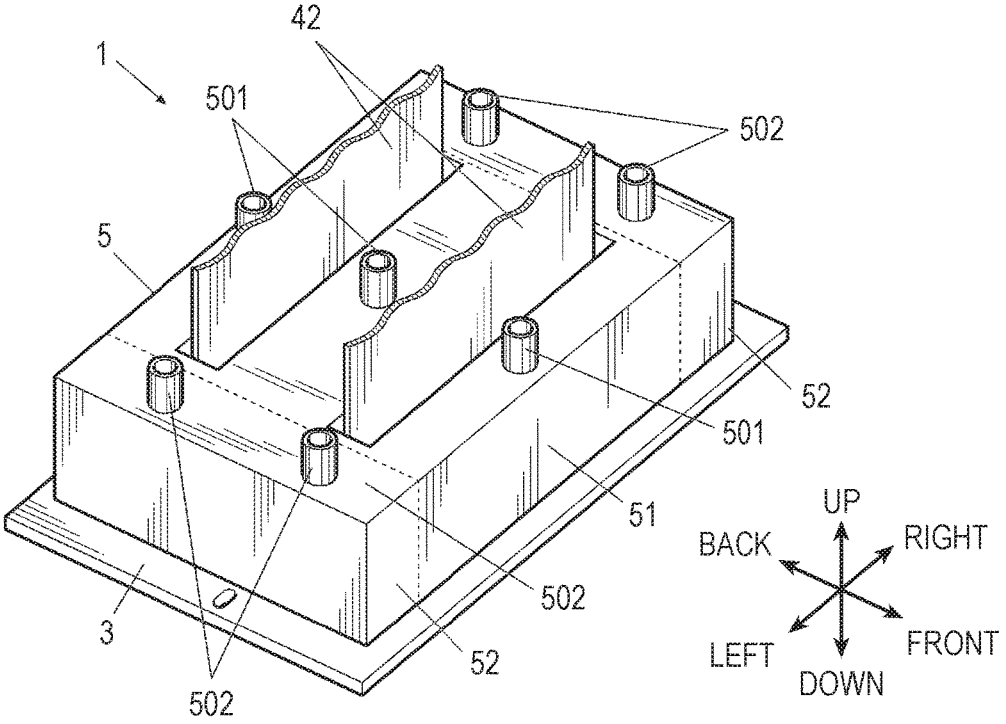
FIG. 2A is a perspective view of the inkjet head from an upper side.
Figure 2B:
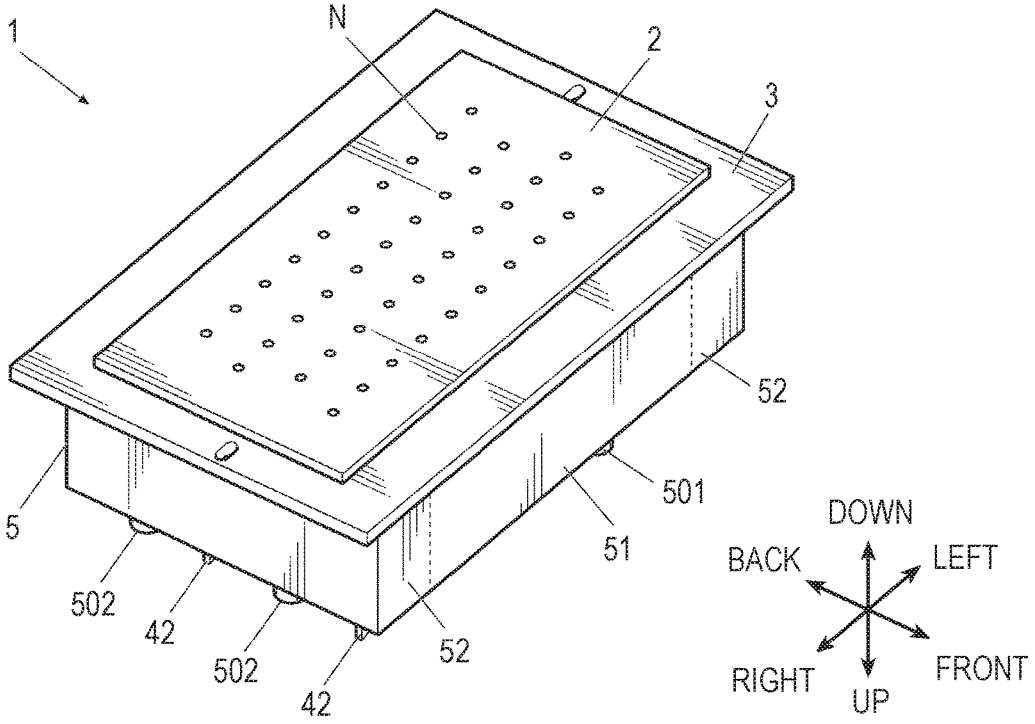
FIG. 2B is a perspective view of the inkjet head from a lower side.

The inkjet head 1 includes a head chip 2, a holding portion 3, a common ink chamber 5, and the like (FIG. 2A, FIG. 2B, and the like).

(Head Chip)

Figure 5:
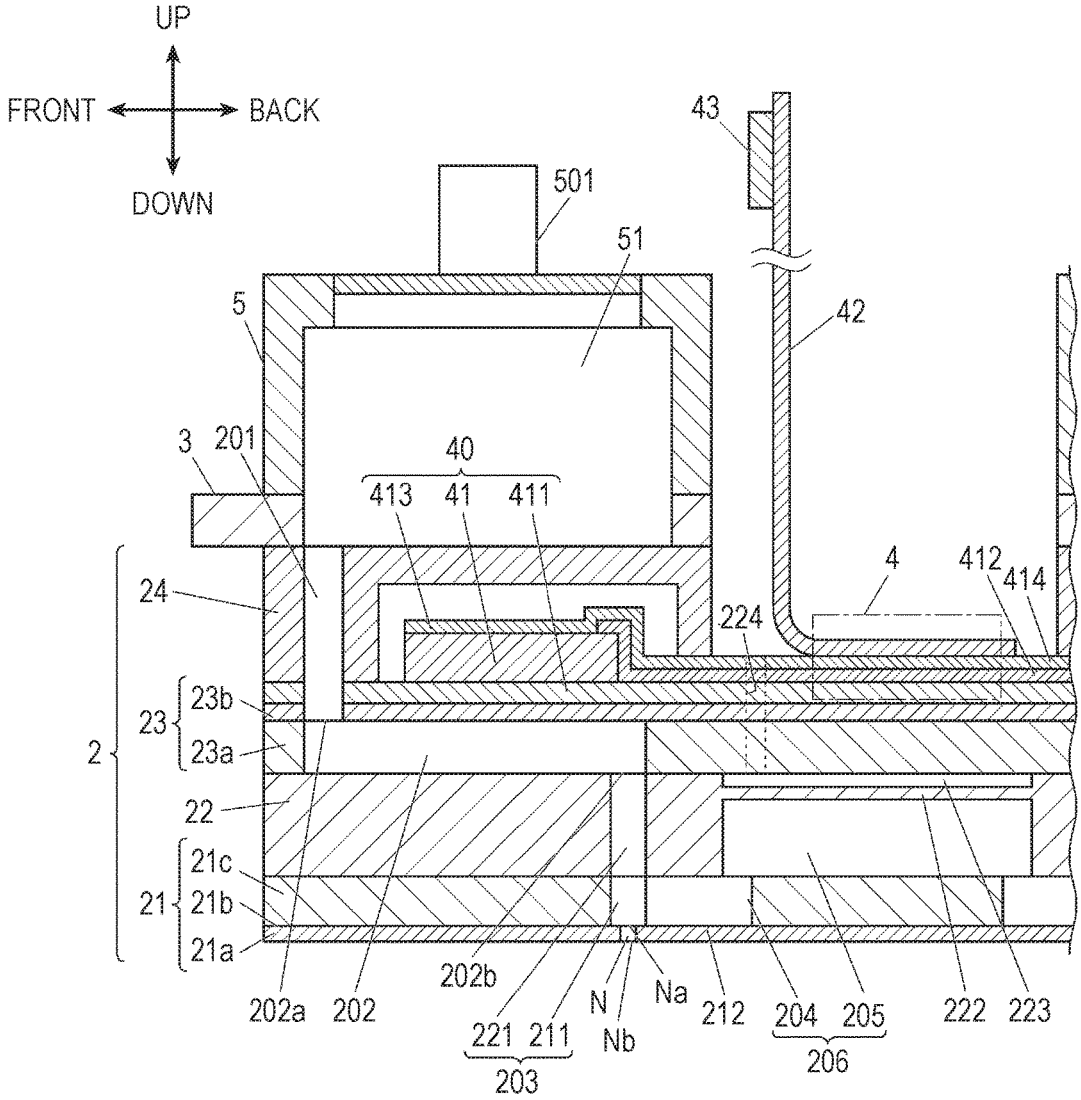
FIG. 5 is an enlarged view of a cross-section of the inkjet head.

The head chip 2 has a configuration in which the nozzle substrate 21, an intermediate substrate 22, the actuator substrate 23, and a protective substrate 24 are sequentially laminated from a lower side and are integrated on an inner side thereof (refer to FIG. 5).

For example, the nozzle substrate 21 is constituted by an SOI substrate including three layers of a nozzle layer 21*a*, an oxide film layer 21*b*, and a nozzle support layer 21*c*.

The nozzle layer 21*a* is a layer in which nozzles N for ejection of liquid droplet of ink are formed, and is constituted by, for example, a Si substrate having a thickness of 10 to 20 μm. For example, the nozzles N are provided in parallel in a plurality of rows (for example, four lows) along the right-left direction (refer to FIG. 2 and FIG. 3B). In addition, an ink-repellent film (not illustrated) is formed on a nozzle surface that is a lower surface of the nozzle layer 21*a*.

For example, the oxide film layer 21*b* is constituted by a $SiO_2$ substrate having a thickness of 0.3 to 1.0 μm.

For example, the nozzle support layer 21*c* is constituted by a Si substrate having a thickness of 100 to 300 μm. A large-diameter portion 211 that communicates with each of the nozzles N and has a diameter greater than that of the nozzle N, and an individual circulation flow passage 204 that is provided to be branched from the large-diameter portion 211 in the front-back direction and is used for circulation of ink are formed in the nozzle support layer 21*c*. In addition, a first damper 212 is formed to face a lower surface of the individual circulation flow passage 204.

The first damper 212 is constituted by a thin Si substrate of the nozzle layer 21*a*, and a volume of the individual circulation flow passage 204 can be changed through minute elastic deformation in correspondence with a pressure. For example, when a circulation flow rate of ink becomes faster, a pressure applied to the inside of the individual circulation flow passage 204 is raised, and thus the first damper 212 is elastically deformed in a downward direction. Accordingly, it is possible to prevent rapid pressure fluctuation in an ink flow passage. In addition, when the first damper 212 is deformed, it is possible to quickly supply ink to a pressure chamber 202 after liquid droplet ejection through the large-diameter portion 211.

The nozzle layer 21*a* and the nozzle support layer 21*c* are constituted by the Si substrate, and thus processing thereof is easily realized through dry etching or wet etching. In addition, since the oxide film layer 21*b* is a layer having a very low etching rate, in a case where the nozzle layer 21*a* and the nozzle support layer 21*c* are processed toward the oxide film layer 21*b*, even when processing unevenness exists in the nozzle layer 21*a* or the nozzle support layer 21*c*, it is possible to control the processing with the oxide film layer 21*b*.

Here, the individual circulation flow passage 204 is formed by a void portion that faces the oxide film layer 21*b*, and thus the individual circulation flow passage 204 is manufactured through high-accuracy processing. Furthermore, the oxide film layer 21*b* may be removed with wet-etching processing using buffered hydrofluoric acid (BHF) after forming the void portion that faces the oxide film layer 21*b*.

For example, the intermediate substrate 22 is constituted by a Si substrate having a thickness of 100 to 300 μm, and a communication hole 221, a common circulation flow passage 205, and a second damper 222 are provided in the intermediate substrate 22.

The communication hole 221 passes through the intermediate substrate 22 in the up-down direction and communicates with the large-diameter portion 211. The communication hole 221 and the large-diameter portion 211 constitute a communication passage 203 through which the pressure chamber 202 and the nozzle N communicate with each other, and become an ink flow passage during ink ejection.

Furthermore, the communication hole 221 may be formed to adjust kinetic energy, which is applied to ink during ink ejection, through shape adjustment of an ink flow passage such as adjustment into a shape in which a diameter of an ink passage route is narrowed.

The common circulation flow passage 205 is provided at a site located on a lower side of a mounting portion 4 to be described later (refer to FIG. 5). The common circulation flow passage 205 communicates with a plurality of the individual circulation flow passages 204 formed in the nozzle support layer 21*c*, and joining of ink, which flows from each of the plurality of individual circulation flow passages 204, occurs in the common circulation flow passage 205. In addition, in the following description, the individual circulation flow passages 204, and the common circulation flow passage 205 are collectively referred to as a circulation flow passage 206.

For example, the second damper 222 is constituted by a Si substrate having a thickness of 1 to 30 μm, and is provided to face an upper surface of the common circulation flow passage 205. An air chamber 223 is formed on an upper surface of the second damper 222. The second damper 222 can change a volume of the common circulation flow passage 205 through elastic deformation due to a pressure difference between the common circulation flow passage 205 and the air chamber 223. For example, in a case where a pressure is applied to the pressure chamber 202 at a time, and ink flows to the common circulation flow passage 205 at a time, a pressure inside the common circulation flow passage 205 is raised, and the second damper 222 is elastically deformed in an upward direction. According to this, it is possible to prevent rapid pressure fluctuation in an ink flow passage.

In addition, the second damper 222, which is elastically deformed in an upward direction, is rapidly elastically deformed in a downward direction immediately after liquid droplet ejection, and thus it is possible to minutely and quickly supply a constant amount of ink to the pressure chamber 202 from which ink is reduced due to ejection. Accordingly, it is possible to prevent meniscus break in a nozzle N located at a midway position.

In addition, as illustrated in FIG. 3B, a region in which the second damper 222 is provided is formed to further extend in an arrangement direction (right-left direction) of nozzles N in comparison to positions of a right-end nozzle Nr and a left-end nozzle Nl in a nozzle arrangement direction (right-left direction) in a region Al in which a plurality of the nozzles N are provided.

Furthermore, the second damper 222 may be provided to face the lower surface of the common circulation flow passage 205, or may be provided to face both of the upper surface and the lower surface of the common circulation flow passage 205.

The air chamber 223 is formed in a thickness (for example, 1 to 100 μm) capable of elastically deforming the second damper 222. In addition, the air chamber 223 is formed to have a volume smaller than that of the common circulation flow passage 205.

In addition, the air chamber 223 includes an air communication portion 224 that communicates with the air (refer to FIG. 5), and has a configuration capable of opening and closing the air communication portion 224 with a lid and the like. According to this, it is possible to adjust a pressure inside the air chamber 223, and thus it is possible to adjust a deformation amount during elastic deformation of the second damper 222.

Furthermore, it is not necessary for the air chamber 223 to have the air communication portion 224, and the air chamber 223 may be set to a hermetically closed space inside the head chip 2.

The actuator substrate 23 as a substrate in which a plurality of pressure generation portions 40 (pressure generation means) are arranged includes a pressure chamber layer 23*a* and a vibration layer 23*b*, and is constituted by an SOI substrate.

For example, the pressure chamber layer 23*a* is constituted by a Si substrate having a thickness of approximately 100 to 300 μm, and the pressure chamber 202 is formed in the pressure chamber layer 23*a*. The pressure chamber 202 communicates with the communication passage 203 of the intermediate substrate 22, and is filled with ink that is ejected from the nozzles N.

For example, the vibration layer 23*b* is an elastically deformable thin Si substrate having a thickness of approximately 20 to 30 μm, and is formed on one surface that is an upper surface of the pressure chamber layer 23*a*. The vibration layer 23*b* vibrates due to an operation of each piezoelectric substance 41 provided on an upper surface of the vibration layer 23*b*, and thus a pressure is applied to ink inside the pressure chamber 202 provided on a lower side of the piezoelectric substance 41. In addition, the pressure generation portion 40 is provided on an upper surface of the vibration layer 23*b*.

The pressure generation portion 40 as the pressure generation means include a lower electrode 411, the piezoelectric substance 41, an upper electrode 413, and the like which are sequentially provided from a lower side. When a voltage is applied between the electrodes from the outside, the piezoelectric substance 41 is expanded and contracted, and thus displacement occurs in the up-down direction.

Specifically, on the upper surface of the vibration layer 23*b*, a thin-film-shaped layer of titanium (Ti), platinum (Pt), and the like is formed to form the lower electrode 411, a thin-film-shaped layer of a piezoelectric material such as lead zirconate titanate (PZT) is formed through a sputtering method a sol-gel method, and the like to form the piezoelectric substance 41, and a thin-film-shaped layer of chromium (Cr), gold (Au), and the like is formed to form the upper electrode 413. Here, an insulating layer 412 such as $SiO_2$ is formed between the lower electrode 411 and the individual interconnections 414 which are connected to the upper electrode 413. In addition, the layers are formed through patterning thereof by photolithography, etching, and the like, and etching of a Si substrate that is a support layer.

As described above, the pressure generation portion 40 is integrally formed with the vibration layer 23*b*. Specifically, "integrally formed" stated here represents formation on the upper surface of the vibration layer 23*b*, for example, by a semiconductor process including the lamination process of the respective electrodes and the piezoelectric substance as described above. However, there is no limitation thereto, and "integrally formed" represents formation without using an adhesive that bonds the layers. Furthermore, the pressure generation portion 40 can be manufactured, for example, by a semiconductor process described in JP 4935965 B2, and the like.

A plurality of the piezoelectric substances 41 are arranged in a plurality of rows in correspondence with nozzle rows (refer to FIG. 3B). In addition, in a direction in which a pair of adjacent rows among the plurality of rows face each other, the individual interconnection 414 is led out from the upper electrode 413 in a columnar shape, and an end of the individual interconnection 414 and a flexible printed substrate 42 as an electric member are electrically connected to each other at the mounting portion 4. For example, the individual interconnection 414 and the flexible printed substrate 42 are thermally compressed to each other with an anisotropic conductive film (ACF) interposed therebetween, and thus connection terminals, which are respectively provided in the individual interconnection 414 and the flexible printed substrate 42, are electrically connected to each other.

In addition, when electricity is supplied from a drive IC 43 connected to the flexible printed substrate 42 through the flexible printed substrate 42, a voltage is applied between electrodes with the piezoelectric substance 41 interposed therebetween.

The individual interconnection 414 is integrally formed on the actuator substrate by a semiconductor process of forming the above-described pressure generation portion 40. In addition, the mounting portion 4 can be formed on the actuator substrate, and thus it is not necessary to separately provide in interconnection substrate. According to this, it is possible to simplify a configuration of the head chip 2.

For example, the protective substrate 24 is a substrate formed from 42 alloy, and a space portion that accommodates the pressure generation portion 40 and the like is formed in the protective substrate 24. In addition, a supply flow passage 201, which passes through the protective substrate 24 in the up-down direction, is formed independently from the space portion, and a common supply-liquid chamber 51 and the pressure chamber 202 communicate with each other through the supply flow passage 201.

Next, description will be given of an ink circulation route inside the head chip 2. Ink is supplied from the common supply-liquid chamber 51 of the common ink chamber 5 to the supply flow passage 201 that is provided in correspondence with each of the nozzles N. Next, ink flows to the pressure chamber 202, . . . , the communication passage 203, . . . , is branched from the communication passage 203, and flows to the individual circulation flow passages 204, . . . . Next, ink from each of the individual circulation flow passages 204, . . . joins at the common circulation flow passage 205, and flows toward ends of the head chip 2 in the right-left direction. Finally, the ink is discharged to a common discharge-liquid chamber 52 of the common ink chamber 5 (refer to FIG. 3 to FIG. 5, and the like).

Furthermore, from the viewpoint of securing spaces in which the mounting portion 4 and the common circulation flow passage 205, as described above, it is preferable that the mounting portion 4 and the common circulation flow passage 205 are provided for every two rows among a plurality of nozzle rows, but may be provided for each row.

In addition, description has been given of an example in which the circulation flow passage 206 is provided to be branched from the communication passage 203 through which the nozzles N and the pressure chamber 202 communicate with each other, but the circulation flow passage 206 may be provided to be branched from an ink flow passage ranging from an inlet 202*a* of the pressure chamber 202 to an outlet Nb of the nozzles N. Here, the circulation flow passage 206 is preferably provided to be branched from a portion, which ranges from an end on the outlet 202*b* side of the pressure chamber 202 to the outlet Nb of the nozzles N, in the ink flow passage The inlet 202*a* (ink inlet) and the outlet 202*b* (ink outlet that communicates with an inlet Na of the nozzles N) of the pressure chamber 202, and the inlet Na (ink inlet) and an outlet Nb (ink outlet) of the nozzles N are illustrated in FIG. 5.

In addition, in a case where the circulation flow passage 206 is branched from the nozzles N, when a substrate, in which the nozzles N are formed as a penetration hole, is set as a nozzle-formed substrate, it is preferable to construct the circulation flow passage 206 by forming a groove that is formed in a surface of the nozzle-formed substrate on the pressure chamber 202 side in correspondence with each of the nozzles N and becomes the circulation flow passage 206, and by joining the nozzle-formed substrate to a flow passage substrate in which a flow passage that communicates with the nozzle N is formed.

Here, the common circulation flow passage 205 may be formed in the nozzle-formed substrate, or the flow passage substrate.

For example, in a case where the common circulation flow passage 205 is formed in the flow passage substrate, it is preferable to construct the circulation flow passage 206 by forming a groove (individual circulation flow passage 204) that is formed in the nozzle-formed substrate in correspondence with each of the nozzles N and reaches the common circulation flow passage 205 that is adjacent to one side, and by joining the nozzle-formed substrate to the flow passage substrate in which the common circulation flow passage 205 is formed.

For example, in the embodiment illustrated in FIG. 5, the oxide film layer 21*b* and the nozzle support layer 21*c* is excluded, and the nozzle layer 21*a* is set as a nozzle-formed substrate having a thickness of, for example, 100 to 300 μm. The individual circulation flow passage 204 and the common circulation flow passage 205 can be formed by forming a groove that is formed in a surface of the nozzle-formed substrate on the intermediate substrate 22 side to communicate with the nozzle N, reaches the common circulation flow passage 205 that is adjacent to the other side, and becomes the individual circulation flow passage 204, and by joining the nozzle-formed substrate to the intermediate substrate 22 (flow passage substrate). In a case where the intermediate substrate 22 is not provided, the individual circulation flow passage 204 and the common circulation flow passage 205 may be formed by providing the common circulation flow passage 205, the second damper 222, and the air chamber 223 in the pressure chamber substrate that constitutes the pressure chamber layer 23*a*, and by joining the nozzle-formed substrate to the pressure chamber substrate (flow passage substrate).

In addition, in a case where the circulation flow passage 206 is branched from the nozzle N, it is preferable to employ a tapered shape in which a hole diameter of the nozzle N gradually decreases from an inlet Na side of the nozzle N.

In a case where the circulation flow passage 206 is branched from an end on the outlet 202*b* side of the pressure chamber 202, it is preferable to construct the circulation flow passage 206 by forming a groove that is formed in a surface of the pressure chamber substrate, in which the pressure chamber 202 is formed, on the nozzle N side in correspondence with the pressure chamber 202, and becomes the circulation flow passage 206, and by joining the pressure chamber substrate to the flow passage substrate in which the flow passage that communicates with the pressure chamber 202 is formed.

The common circulation flow passage 205 may be formed in the pressure chamber substrate or the flow passage substrate.

In a case where the common circulation flow passage 205 is formed in the flow passage substrate, it is preferable to construct the circulation flow passage 206 by forming a groove (individual circulation flow passage 204) that is formed in the pressure chamber substrate in correspondence with the pressure chamber 202 and reaches the common circulation flow passage 205 that is adjacent to one side, and by joining the pressure chamber substrate to the flow passage substrate in which the common circulation flow passage 205 is formed.

For example, in the embodiment illustrated in FIG. 5, the oxide film layer 21*b* and the nozzle support layer 21*c* are excluded. Vertical positions of the air chamber 223 and the common circulation flow passage 205 in the intermediate substrate 22 are switched from each other to dispose the common circulation flow passage 205 on an upper side. The individual circulation flow passage 204 and the common circulation flow passage 205 can be formed by forming a groove that is formed in a surface of the pressure chamber substrate, which constitutes the pressure chamber layer 23*a*, on the intermediate substrate 22 side to communicate with the pressure chamber 202, reaches the common circulation flow passage 205 that is adjacent to the other side, and becomes the individual circulation flow passage 204, and by joining the pressure chamber substrate to the intermediate substrate 22 (flow passage substrate). In a case where the intermediate substrate 22 is not provided, for example, the individual circulation flow passage 204 and the common circulation flow passage 205 may be formed by providing the common circulation flow passage 205, the second damper 222, and the air chamber 223 in the pressure chamber substrate that constitutes the pressure chamber layer 23*a*, and by joining the pressure chamber substrate to the nozzle-formed substrate (flow passage substrate) that constitutes the nozzle layer 21*a*.

(Holding Portion)

The holding portion 3 is joined to an upper surface of the head chip 2 and supports the common ink chamber 5. After the holding portion 3 is aligned with and provided on the upper surface of the head chip 2, the common ink chamber 5 can be provided by using the holding portion 3 as a mark. Accordingly, it is possible to form the common ink chamber 5 on the upper surface of the head chip 2 with high accuracy.

In addition, it is preferable to perform joining in a state in which an alignment mark (not illustrated) is provided to each of the head chip 2 and the holding portion 3 from the viewpoint of performing alignment with high accuracy.

(Common Ink Chamber)

The common ink chamber 5 includes the common supply-liquid chamber 51, and two common discharge-liquid chambers 52 (refer to FIG. 2A and the like). For example, each ink chamber is filled with ink of one color among cyan (C), magenta (M), yellow (Y), and black (K). In addition, the common ink chamber 5 is provided with a space at a portion on an upper side of the mounting portion 4 so that the flexible printed substrate 42 connected to the mounting portion 4 can be led to the outside of the common ink chamber 5.

The common supply-liquid chamber 51 is provided on an upper side of the pressure chamber 202 and at the central portion of the common ink chamber 5, and a lower surface of the common supply-liquid chamber 51 communicates with the supply flow passage 201 that is provided in the head chip 2. In addition, the common supply-liquid chamber 51 is supplied with ink from an ink supply port 501 provided on an upper side thereof and is filled with the ink to be supplied to the head chip 2.

The two common discharge-liquid chambers 52 are respectively provided on end sides of the common ink chamber 5 in the right-left direction, and communicate with the common circulation flow passage inside the head chip.

In addition, the common discharge-liquid chambers 52 are filled with ink that is discharged from the inside of the head chip 2, and the ink is discharged from an ink discharge port 502 that is provided in an upper side.

[Ink Circulation Mechanism]

The ink circulation mechanism 6 as ink circulation means include a main tank 61, a supply sub-tank 62, a circulation sub-tank 63, and the like (FIG. 6).

The supply sub-tank 62 is filled with ink that is to be supplied to the common supply-liquid chamber 51 of the common ink chamber 5, and is connected to the ink supply port 501 through an ink flow passage 72.

The circulation sub-tank 63 is filled with ink that is discharged from the common discharge-liquid chambers 52 of the common ink chamber 5, and is connected to ink discharge ports 502 and 502 through an ink flow passage 73.

In addition, the supply sub-tank 62 and the circulation sub-tank 63 are provided at positions different from each other in the up-down direction (gravity direction) with respect to a nozzle surface (hereinafter, also referred to as "positional reference surface") of the head chip 2. Accordingly, a pressure P1 due to a water head difference between the positional reference surface and the supply sub-tank 62, and a pressure P2 due to a water head difference between the positional reference surface and the circulation sub-tank 63 occur.

In addition, the supply sub-tank 62 and the circulation sub-tank 63 are connected to each other by an ink flow passage 74. In addition, ink can be returned from the circulation sub-tank 63 to the supply sub-tank 62 due to a pressure that is applied by a pump 82.

The main tank 61 is filled with ink to be supplied to the supply sub-tank 62, and is connected to the supply sub-tank 62 through an ink flow passage 71. In addition, ink can be supplied from the main tank 61 to the supply sub-tank 62 due to a pressure that is applied by a pump 81.

As described above, the pressure P1 and the pressure P2 can be adjusted through adjustment of the amount of ink in each of the sub-tanks, and positional change of the sub-tanks in the up-down direction (gravidity direction). In addition, it is possible to circulate ink on an upper side of the nozzle N at an appropriate circulation flow rate due to a pressure difference between the pressure P1 and the pressure P2. According to this, air bubbles which are generated inside the head chip 2 are removed, and thus it is possible to suppress nozzle clogging, ejection failure, and the like.

[Technical Effect in Invention]

As described above, the inkjet head 1 of the invention includes the circulation flow passage 206 that is provided to be branched from the ink flow passage ranging from the inlet 202*a* of the pressure chamber 202 to the outlet Nb of the nozzle N, and can discharge ink inside the pressure chamber 202, and the first damper 212 and the second damper 222 which are provided to face the circulation flow passage 206, and are elastically deformed in correspondence with a pressure to change the volume of the circulation flow passage 206.

In the configuration of the invention, since the first damper 212 and the second damper 222 are provided in the circulation flow passage 206, it is possible to suppress pressure fluctuation inside the ink flow passage. According to this, it is possible to miniaturize the inkjet head 1. In addition, it is possible to stably eject liquid droplets at a high frequency while having a structure capable of circulating ink when considering that pressure fluctuation inside the flow passage can be suppressed. According to this, it is also possible to attain an effect of suppressing ink leakage due to occurrence of meniscus break.

In addition, in the inkjet head 1 of the invention, the circulation flow passage 206 is provided to be branched from a portion ranging from an end on the outlet 202*b* side of the pressure chamber 202 and the outlet Nb of the nozzle N, and thus it is possible to circulate ink in the vicinity of the nozzle N.

In addition, the inkjet head 1 of the invention includes the communication passage 203 through which the nozzle N and the pressure chamber 202 communicate with each other, and the circulation flow passage 206 is provided to be branched from the communication passage 203. Accordingly, it is possible to circulate ink in the vicinity of the nozzle N.

In addition, in the inkjet head 1 of the invention, the second damper 222 is provided to face the common circulation flow passage 205. According to this, the second damper 222 can be provided in a relatively wide region, and thus it is possible to effectively suppress pressure fluctuation inside the flow passage.

In addition, in the inkjet head 1 of the invention, the second damper 222 is provided at least one side of the upper side and the lower side of the common circulation flow passage 205, and the air chamber 223 is provided to face the second damper 222 on a side opposite to the common circulation flow passage 205 side. In a configuration in which the air chamber 223 is provided, it is also possible to form the second damper 222 at the inside of the head chip 2.

In addition, a nozzle surface side of the inkjet head 1 may come into contact with a printing object or may come into contact with a maintenance mechanism of the recording apparatus, and thus it is preferable that the second damper 222 is located on an upper side that is opposite to the nozzle surface so as to enhance the strength of the inkjet head 1.

In addition, in the inkjet head 1 of the invention, the volume of the air chamber 223 is set to be smaller than the volume of the common circulation flow passage 205. According to this, it is possible to increase the volume of the common circulation flow passage 205 by providing the air chamber 223 in a limited space inside the head chip 2.

In addition, in the inkjet head 1 of the invention, the air chamber 223 includes the air communication portion 224 that communicates with the air. According to this, it is possible to adjust a pressure inside the air chamber 223, and thus it is possible to adjust a deformation amount during elastic deformation of the second damper 222.

In addition, in the inkjet head 1 of the invention, a plurality of the nozzles N are arranged in one row or a plurality of rows. A region, in which the common circulation flow passage 205 and the second damper 222 are provided, further extends in an arrangement direction of the plurality of nozzles N in comparison to a position of a nozzle N at an end of a region in which the plurality of nozzles N are provided in the arrangement direction of the plurality of nozzles N. According to this, it is possible to effectively suppress deterioration of ejection performance of the nozzle N at the end in the arrangement direction (right-left direction) of the nozzle N.

In addition, in the inkjet head 1 of the invention, the nozzles N are arranged in a plurality of rows, and the common circulation flow passage 205 is provided for each row or for every two rows among the plurality of rows. According to this, it is possible to miniaturize the head chip 2.

[Others]

It should be understood that the embodiment of the invention disclosed here is illustrative only and is not restrictive in all aspects. The scope of the invention is represented by the appended claims rather than being limited to the above description, and is intended to include meaning equivalent to the appended claims and all modification in the scope.

For example, description has been given on the assumption that the second damper 222 is constituted by a Si substrate having a thickness of 1 to 30 μm, but the configuration can be appropriately changed as long as elastic deformation is possible. For example, the second damper 222 may be formed by a stainless steel plate having an appropriate thickness, or an elastic resin member.

In addition, the first damper 212 and the second damper 222 may be provided to face the circulation flow passage 206, and the size thereof or a surface on which the first damper 212 and the second damper 222 are provided may be appropriately changed. Furthermore, it is preferable that the first damper 212 and the second damper 222 are provided on an upper surface or a lower surface of the circulation flow passage 206 from the viewpoint of manufacturing efficiency, but may be provided with respect to a left surface or a right surface of the circulation flow passage 206.

In addition, it is preferable that the individual circulation flow passages 204 are provided in the nozzle substrate 21 as illustrated in Examples from the viewpoint of removing air bubbles or foreign matters at a position close to the nozzles N, but may be formed in the intermediate substrate 22.

In addition, with regard to the common ink chamber 5, the common supply-liquid chamber 51 and the common discharge-liquid chamber 52 are provided to be separated from each other at the inside of the common ink chamber 5, but may be formed as an independent ink chamber.

In addition, the common ink chamber 5 is formed in a shape in which a space for leading out the flexible printed substrate 42 to an upper side is empty, but the shape may be appropriately changed.

In addition, as the ink circulation mechanism 6, description has been given of a method of controlling circulation of ink by using the water head difference, but it should be understood that the ink circulation mechanism 6 can be appropriately changed as long as a circulating flow as in the invention can be generated.

INDUSTRIAL APPLICABILITY

The invention can be used in an inkjet head and an inkjet recording apparatus.

REFERENCE SIGNS LIST

1 Inkjet head
202 Pressure chamber
202*a* Inlet of pressure chamber
202*b* Outlet of pressure chamber
203 Communication passage
204 Individual circulation flow passage
205 Common circulation flow passage
206 Circulation flow passage
212 First damper
222 Second damper
224 Air communication portion
23 Actuator substrate
4 Mounting portion
40 Pressure generation portion (pressure generation means)
41 Piezoelectric substance
414 Individual interconnection
51 Common supply-liquid chamber
6 Ink circulation mechanism (ink circulation means)
100 Inkjet recording apparatus
N Nozzle
Nb Outlet of nozzle

The invention claimed is:

1. An inkjet head, comprising:
a plurality of nozzles which eject ink;
a plurality of pressure chambers which are respectively communicate with the plurality of nozzles and are filled with ink;
a plurality of pressure generation means which are respectively provided in correspondence with the plurality of pressure chambers, and apply a pressure to ink inside the pressure chambers;
a circulation flow passage that is provided to be branched from an ink flow passage ranging from an inlet of the pressure chambers and an outlet of the nozzles, and is capable of discharging ink inside the plurality of pressure chambers; and
a damper that is provided to face the circulation flow passage, and is capable of changing a volume of the circulation flow passage through elastic deformation in correspondence with a pressure.

2. The inkjet head according to claim 1,
wherein the circulation flow passage is provided to be branched from a portion, which ranges from an end on an outlet side of the pressure chambers to the outlet of the nozzles, in the ink flow passage.

3. The inkjet head according to claim 1,
wherein the ink flow passage includes a communication passage through which each of the nozzles and each of the pressure chambers communicate with each other, and
the circulation flow passage is provided to be branched from the communication passage.

4. The inkjet head according to claim 1,
wherein the circulation flow passage includes a plurality of individual circulation flow passages which communicate with the ink flow passage, and a common circulation flow passage through which at least two of the plurality of individual circulation flow passages communicate with each other, and
the damper is provided to face the common circulation flow passage.

5. The inkjet head according to claim 4,
wherein the damper is provided on at least one side of an upper side and a lower side of the common circulation flow passage, and includes an air chamber, which faces the damper, on a side opposite to the common circulation flow passage.

6. The inkjet head according to claim 5,
wherein a volume of the air chamber is smaller than a volume of the common circulation flow passage.

7. The inkjet head according to claim 5,
wherein the air chamber includes an air communication portion that communicates with the air.

8. The inkjet head according to claim 4,
wherein the plurality of nozzles are arranged in one row or a plurality of rows, and
a region, in which the damper is provided, further extends in an arrangement direction of the plurality of nozzles in comparison to a position of a nozzle at an end of a region in which the plurality of nozzles are provided in an arrangement direction of the plurality of nozzles.

9. The inkjet head according to claim 4, wherein the plurality of nozzles are arranged in a plurality of rows, and the common circulation flow passage is provided for every two rows among the plurality of rows.

10. An inkjet recording apparatus, comprising:

the inkjet head according to claim 1; and circulation means that generates a circulating flow from the ink flow passage to the circulation flow passage.

11. The inkjet head according to claim 9, wherein in a pair of adjacent rows among the plurality of rows, the plurality of individual circulation flow passages communicate with the same common circulation flow passage.

12. The inkjet head according to claim 11, further comprising:

a mounting portion to which an individual interconnection connected to each of the plurality of pressure generators is led out, and at which the individual interconnection and an electric member are connected to each other, wherein in a pair of adjacent rows among the plurality of rows, the individual interconnection is led out to the same mounting portion from the plurality of pressure generators.

13. The inkjet head according to claim 1, wherein the circulation flow passage includes a plurality of individual circulation flow passages which communicate with the ink flow passage, and a common circulation flow passage through which at least two of the plurality of individual circulation flow passages communicate with each other, and the damper is provided to face the individual circulation flow passages.

14. The inkjet head according to claim 1, further comprising:

a common supply-liquid chamber that is provided on an upper side of the plurality of pressure chambers, and stores ink to be supplied to each of the plurality of pressure chambers; and a common discharge-liquid chamber that is arranged in parallel to the common supply-liquid chamber, and is filled with ink discharged from the circulation flow passages.

15. The inkjet head according to claim 4, further comprising:

a common discharge-liquid chamber that is filled with ink discharged from both ends of the common circulation flow passage.

16. The inkjet head according to claim 4, further comprising:

a mounting portion to which an individual interconnection connected to each of the plurality of pressure generators is led out, and at which the individual interconnection and an electric member are connected to each other, wherein the common circulation flow passage is provided on a lower side of the mounting portion.

17. The inkjet head according to claim 1, wherein the damper is a Si substrate.

18. The inkjet head according to claim 5, wherein a pressure in the air chamber is capable of being adjusted.

19. The inkjet head according to claim 4, wherein in a direction in which ink is ejected from the nozzles, a length of the individual circulation flow passage is longer than a length of the nozzles.

20. The inkjet recording apparatus according to claim 10, wherein the circulator includes:

a supply sub-tank that is filled with ink to be supplied to the inkjet head;

a circulation sub-tank that is filled with ink discharged from the inkjet head;

a pump that generates a pressure for returning ink from the circulation sub-tank to the supply sub-tank; and a main tank that is filled with ink to be supplied to the supply sub-tank.

* * * * *